US006068362A

United States Patent [19]

Dunand et al.

[11] Patent Number: 6,068,362

[45] Date of Patent: May 30, 2000

[54] CONTINUOUS MULTICOLOR INK JET PRESS AND SYNCHRONIZATION PROCESS FOR THIS PRESS

[75] Inventors: Alain Dunand, Valence; Daniel Esteoulle, Toulaud, both of France

[73] Assignee: Imaje S.A., Bourg-les-Valence Cedex, France

[21] Appl. No.: 08/963,139

[22] Filed: Nov. 3, 1997

[30] Foreign Application Priority Data

Nov. 15, 1996 [FR] France ..... 96 13961

[51] Int. Cl.[7] ..... B41J 2/01

[52] U.S. Cl. ..... 347/16; 347/104

[58] Field of Search ..... 347/14, 16, 19, 347/107, 101, 105, 116, 104; 346/23

[56] References Cited

U.S. PATENT DOCUMENTS

| | | | |
|---|---|---|---|
| 4,574,291 | 3/1986 | Wimmer . | |
| 4,686,540 | 8/1987 | Leslie et al. | 346/33 R |
| 4,721,969 | 1/1988 | Asano | 347/116 |
| 4,839,674 | 6/1989 | Hanagata et al. . | |
| 5,121,145 | 6/1992 | Buch et al. . | |
| 5,266,976 | 11/1993 | Ohigashi et al. | 347/116 |
| 5,448,269 | 9/1995 | Beauchamp et al. | 347/19 |
| 5,452,073 | 9/1995 | Kataoka . | |
| 5,521,674 | 5/1996 | Guillory et al. | 399/66 |
| 5,598,201 | 1/1997 | Stodder et al. | 347/104 |
| 5,777,638 | 7/1998 | Salter et al. | 347/12 |
| 5,784,078 | 7/1998 | Furuya | 347/14 |

FOREIGN PATENT DOCUMENTS

| | | |
|---|---|---|
| 0 729 846 A2 | 9/1996 | European Pat. Off. . |
| 2439677 | 5/1980 | France . |

*Primary Examiner*—Robert Beatty

*Attorney, Agent, or Firm*—Pearne, Gordon, McCoy & Granger LLP

[57] ABSTRACT

This invention relates to a continuous multicolor ink jet press comprising a substrate driven by a motor and passing under at least one print head associated with a sensor and supplied by an ink circuit, a synchronization circuit, connected to a process controller and a position encoder placed on the substrate drive motor transmitting a signal to the synchronization circuit, this encoder being a high resolution position encoder. A printing system is located upstream of the printheads and which prints marks regularly on the substrate. These marks are detected by the sensor associated with the printheads.

29 Claims, 6 Drawing Sheets

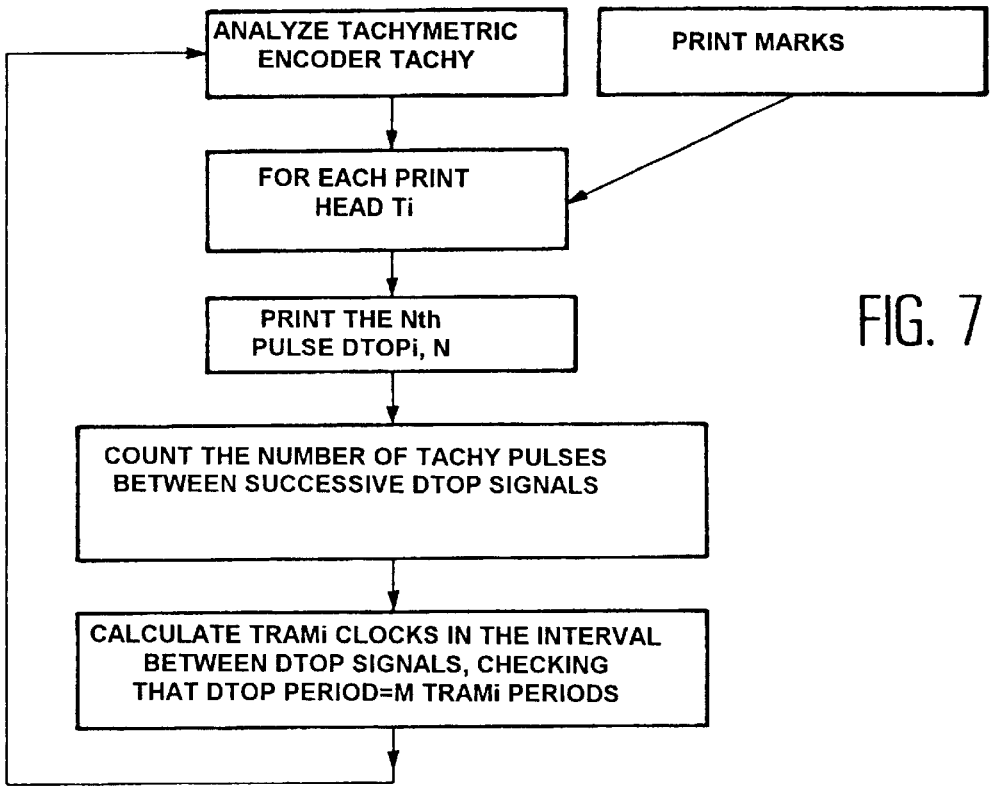
FIG. 7
FIG. 8
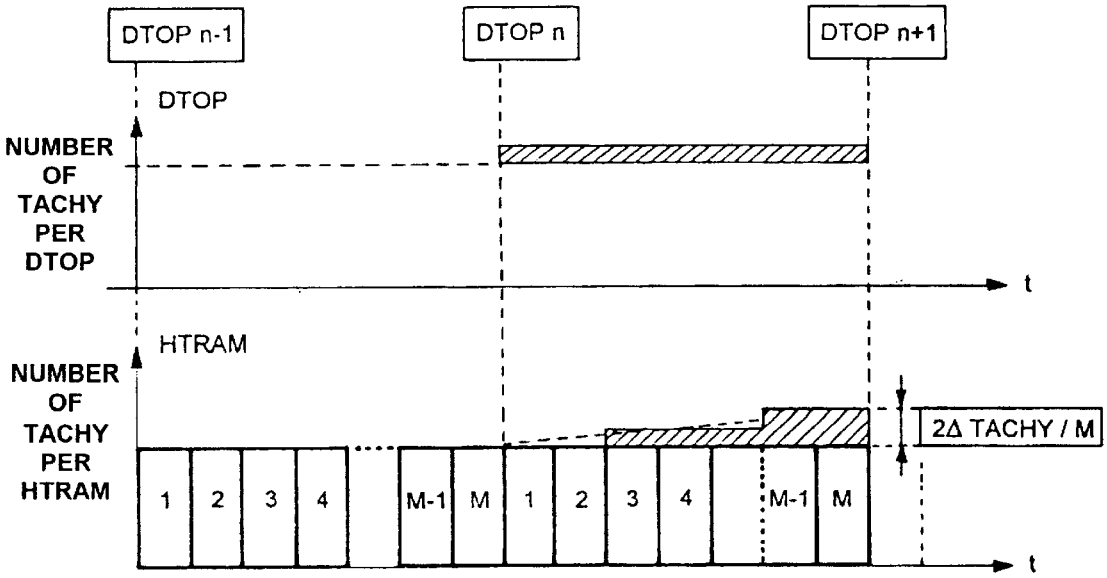

CONTINUOUS MULTICOLOR INK JET PRESS AND SYNCHRONIZATION PROCESS FOR THIS PRESS

DESCRIPTION

1. Technical Field

This invention relates to a continuous multicolor ink jet press, a synchronization process for this press, and a printed product obtained using this press.

2. State of Prior Art

Digital ink jet printing systems have developed a great deal in recent years, particularly in office automation printing applications with color pictures. The ink jet process has undeniable advantages over former contact printing technologies, such as quiet operation and lack of contact with the substrate.

The ink jet is less expensive than other digital color printing techniques such as electro-photography, and also has a better performance in reproduction of colors, and a better ability to print a wide variety of different natures of substrates.

In industrial color printing applications such as printing of textiles, posters, wall or floor coverings, labels, plastic cards or even printing books/magazines or catalogs, printing systems used at the present time still use traditional technologies operating by contact, such as intaglio printing, offset, or silk screen printing. These technologies are expensive to implement since mechanical image carriers such as engraved rolls for intaglio printing, screens for silk screen printing or offset plates have to be made materializing the image to be printed, before they can be applied. The cost and time necessary to make these image carriers is a major obstacle to printing small series in short periods.

The design of printed industrial products has changed under the constraint of traditional printing technologies:

Products are personalized off the production line which is long and expensive.

The production of small series is discouraged by printers who pass on high costs induced by shutting down production while changing image carriers, losses of ink when changing colors and losses of products as a result of adjusting new carriers when resuming printing.

Production is organized in long series combining a large number of identical orders. "Just in time" production to supply distribution circuits with products satisfying immediate consumer demands, is impossible. On the other hand, these traditional production systems generate voluminous and expensive inventories; unsold and deteriorated products are frequent, and stock in production is large.

However, traditional systems are being replaced by systems based on digital printing:

- with the arrival of digital communications systems such as information highways, which provide information about product demand at all times making it possible to order and make "just in time":
  - under the pressure of consumers and users whose needs, tastes and fashions are becoming more and more varied and changeable;
  - under the constraint of distribution circuits that want to reduce their costs, caused largely by stocks and unsold products.

The printing industry will adopt digital production techniques which are more flexible and faster, provided that they do not compromise the printing quality. The ink jet is one of the main candidate techniques envisaged.

Ink jet printing, particularly using the deviated continuous jet technology, is very suitable for the manufacture of very wide print heads, as described in document reference [1] at the end of the description. Continuous multicolor presses can be made, in which several print heads are laid out in series to print a strip substrate passing continuously under the print heads. The cost of these electronic presses is higher than the cost of traditional mechanical presses, but their economic operating conditions are better since they enable just in time production, short series, customization of products in line, and elimination of investments necessary to set up image carriers for new drawings. However, the new operating conditions for digital presses introduce new constraints which were hitherto unknown:

It must be possible to print at variable speed since series are short and result in frequent shutdowns and restarts in the advance of the substrate. To minimize stock in production, in the future the printing process will be carried out on line or integrated with other production steps such as manufacturing of the substrate itself, and gluing, calendering or packaging. Therefore variations in the substrate speed are frequent, since they are related to changes in other processes in the production line.

Quality requirements for products making it necessary to work with a high resolution and increased precision of color superposition and juxtaposition.

Printed series or lengths are very short, sometimes shorter than the length of the substrate present in the printing machine, leading to the simultaneous printout of several patterns in the same machine.

Economic constraints require continuous production, minimizing shutdowns, with increasingly high effective production rates.

On-line customization of products makes it necessary to print a variable digital image on a substrate with an initial preprinted basic pattern, with an excellent relative positioning of the images.

Printing is done more and more frequently with water based inks, therefore without solvents, in order to protect the environment. This makes it necessary to insert cross-linking and/or drying systems between different color print units, which increases product lengths between these units due to their size, and modifies the temperature of the substrate. These two factors, the increase in the length of the production line and the variable temperature environment, increase the substrate deformations in the printer.

Traditional contact printers used in the past for intaglio printing, silk screen printing with a rotary frame, or offset technologies, all work at constant speed. Substrate acceleration phases when starting printing are usually shorter than the time necessary to adjust the image carriers (corresponding to the images of the different primary colors) with respect to each other.

The problem of synchronizing the substrate transient speed phase (acceleration or deceleration) is unknown at the present time. Adjustments are made at constant speed by mechanically moving image carriers relative to each other. When the advance speed is low, the quality of color matches is examined visually on the printed substrate. When the substrate speed is higher, electronic assistance with the adjustment is made by repetitive printing of adjustment test patterns on the border of the strip, and by displaying them on a check monitor, the test patterns being observed by a camera associated with stroboscopic lighting. A slow drift of the setting with time will always occur in practice due to variations in the environment, friction, or even different sizes of the various image carriers; the printer operator maintains the adjustment by continuously monitoring and adjusting the printer setting.

The problem of synchronization between different colors has been dealt with in office digital printers. Thus document reference [2] at the end of the description describes the synchronization of a single pass color electrostatic printer in which the first color print head prints synchronization test patterns at regular intervals at the edge of the substrate. The advance speed is kept constant by servocontrolling the substrate drive motor. During the substrate advance phase, this test pattern is read by CCD cameras on the downstream side, each camera being associated with one print head. Each print head then interprets the distance between the marks on the test pattern measured by its camera, so as to print lines of dots in its own color equally distributed between the test pattern marks on the substrate and thus superpose the different colors.

Since the distance between test pattern marks is smaller than the size of an image, it is also necessary to determine the beginning of the image for each print head. This is done by determining the time difference between the various print heads, at the nominal operating speed. This difference is determined by the operator, who carries out a sequence of print tests on another special calibration test pattern, combining the different colors.

Document reference [3] divulges another type of synchronization system applied to an electro-photographic printer. One difference, with the electrostatic system mentioned above is due to the fact that electro-photographic printing is not a direct printing technique. It involves the transfer of the colored image, which is previously materialized on a transfer belt. This image is then transferred by mechanical contact between the transfer belt and the substrate to be printed. The divulged synchronization system makes each print cylinder associated with a different color print the different test patterns on the transfer belt. A single optical system located on the output side of all print cylinders (but before the transfer onto the substrate), analyzes differences in the positioning of test patterns materialized on the transfer belt in each of the colors. These differences are used to generate corrections to be made to motors that drive cylinders associated with each color. In this case too, printing and synchronization are done at constant speed of the substrate and the transfer belt. No method of defining the precise instant of the beginning of the image has been described.

Document reference [4] divulges a synchronization system for an electro-photographic printer. The image start signal is materialized by a hole in the transfer belt. The various colors can be synchronized based on an optical system detecting this hole and defining delays for each print cylinder. However, this solution makes it impossible to overprint or customize a previously printed document.

Printing substrates at variable speed is also known in industrial marking applications, but in these cases the printout is made in a single color, or in several independent colors; the relative positioning of dots of different colors is not important. However, note that even in monochrome printing, printing at variable speed causes synchronization problems specific to the ink jet technology, due to the intrinsic response time of the print heads. These spray ink droplets from a distance, which will impact the substrate to print on it. The duration of the path of droplets from the print head to the substrate is fixed by the droplet ejection speed and the distance between the ejection nozzle and the substrate, so it is obvious that if the substrate speed varies, a special compensation must be made to take account of the droplet path duration. This type of compensation system to allow for the duration of the droplet path in flight is known in the state of the art and such systems are used commercially, as in IMAGE Series 4 ink jet printers.

The difficulty of synchronizing a multicolor print system printing at variable speed is due to the necessity to have synchronization and information clocks with:

- an excellent resolution to be able to make fine synchronization adjustments. This requires a very fast clock, and/or very fine spatial indexing of the substrate displacement;
- an excellent representativeness of the position of the substrate at each print head, so that the relative positioning of different colored dots is precise. The clock must not be affected by errors caused by slipping or substrate deformations between print heads, particularly during acceleration or deceleration;
- coding of the current production (or image) reference; several different productions may be printed in the printing machine at the same time.

These characteristics, which were unknown in traditional printing techniques, are also very difficult to obtain in an industrial environment due to several factors such as:

- high advance speeds;
- the structure, color or texture of substrates that make it impossible to print indexing marks at high resolution and which are legible in an industrial environment.

The purpose of this invention is a continuous multicolor ink jet press capable of solving the problems mentioned above.

DISCLOSURE OF THE INVENTION

This invention relates to a continuous multicolor ink jet press comprising a substrate driven by a motor and passing under at least one print head associated with a sensor and supplied with ink through an ink circuit, and a process controller, characterized in that it comprises a synchronization circuit connected to this process controller, and to a position encoder located on the substrate drive motor, this encoder (which is a position encoder with a high resolution, typically 3000 to 300,000 dots per motor revolution which gives a high frequency pulse representing a step of a few microns in advance of the substrate, sending a signal to the synchronization circuit; and in that it comprises a device for printing the first marks regularly printed on the substrate.

The use of an encoder, for example placed on the motor rotation axis, and preferably operating by means of an optical device gives a very high resolution signal.

The first marks are printed regularly on the substrate, preferably using another print system located on the input side of the print heads. If a conveyor belt is used, these first marks may be printed or simply materialized during manufacturing of the substrate conveyor belt. In the case of a preprinted substrate, the first marks will have been made during pre-printing.

The geometry and color of these first marks enable unambiguous reading in an industrial environment by an optical system such as a CCD camera and lighting, or a sensor measuring the optical reflection of the substrate. A square block with a side dimension of between one and a few millimeters and a fluorescent color are particularly suitable choices. These marks may indifferently be printed on the front of the substrate or the conveyor belt, or on the back provided that lighting conditions and the reading system are improved. Marks on each print head are read by an optical system. This reading enables generation of a precise pulsed time signal, DTOPi, which defines the instant at which a first mark passes under the sensor associated with the print head Ti. The distance between two first marks is of the order of the distance separating 100 to 5000 lines of printed dots.

In the synchronization circuit according to the invention, the duration between two DTOPi signal pulses always contains an integer and a constant number M of HTRAMi clock periods. The HTRAMi clock is the command signal ordering the print head to print a line of dots. In this way, the same number M of lines of dots can be printed on the substrate between two first marks, for each color, at all times. Thus, since these marks are physically linked to the substrate, the relative positioning of the various colors is under control, even if the substrate is deformed between two print heads.

In practice, the optical sensor generating the DTOPi signal is not placed at the same location as the print head, but is on the input side. More precisely, it is located at a distance from the print head slightly greater than the distance separating two first marks, and less than twice this distance.

According to a third characteristic of the invention, for substrates in strip form, second marks are printed on the substrate which can be unambiguously distinguished from the first marks. These second marks may be printed on the edge of the substrate by the first print head. A preferred embodiment consists of printing these marks on the edge of the substrate on a line parallel to the direction of advance, but located at a good distance from the line of the first marks. In the case of a pre-printed substrate, the second marks will have been made during pre-printing.

The function of these second marks is to signal the change in the pattern to be printed. These second marks are read by an optical system in order to generate a signal called the PATTERN signal, with a coarser precision, indicating the change in the pattern to be printed. In a preferred embodiment, the PATTERN signal is identified by printing and detecting a fast series of a few blocks separated by a distance very much less than the distance between the first marks.

For substrates that are presented in a sheet that may or may not be pre-printed, a second mark may be generated naturally by appearance of the trailing edge of the sheet under the optical sensor, and synchronization is done in the same way as for the strip substrate.

According to another characteristic of the invention, the synchronization circuit performs prediction, filtering and windowing operations for the DTOPi signal read operation in order to make the system very robust. Firstly, detection of the first marks is enabled within a limited time window, which is centered on the instant at which the first mark will probably pass under the sensor. This solution limits disturbant detections which may be related to the presence of parasites. If a first mark is not detected in the read window, a dummy DTOPi signal is generated starting from a prediction based on the interval separating two previous pulses. This means that printing can be continued, particularly when the pattern is changed, even when the first mark could not be detected. At the same time, the read window is widened at the time of the next detection. Printing is stopped if the fault persists after four missing DTOPi signals.

In a preferred embodiment, the offsets between the different colored print heads making up the printing system are measured by intermittent analysis of multi-color calibration test patterns printed by these print heads. The calibration test patterns include geometric patterns that unambiguously identify dots printed by the various print heads. These patterns are printed during the sequenced printed product production process.

The test patterns may be analyzed at the exit from the production line if the product residence time in the line is short, so that corrections and calibration can be done within a short period. However if the production line is long, which is the case for vinyl floor coatings which need to spend several minutes in ovens placed in line immediately after the print location, then an on-line analysis of the test patterns must be made before the product exits from the end of the production line.

According to another characteristic of the invention, there is a test pattern analysis system after each print head consisting of a color camera (CCD type) equipped with suitable optics and fitted on a mechanical displacement system with a macrometric position indexer placed approximately perpendicular to the direction of advance of the substrate, and an associated computer system. The substrate conveyor line is stopped intermittently when the calibration test pattern is approximately under the area scanned by the camera movement. The presence of the calibration test pattern on the substrate may be detected by printing a characteristic PATTERN mark at the edge of the substrate, signaling the presence of a calibration pattern and controlling a temporary stop of the substrate advance. The PATTERN mark is detected by an optical sensor associated with the test pattern analysis system, similar to sensors used on print heads. When the substrate stops under the active area of the analysis system, the camera is moved by the mechanical system at the same time as it analyzes the impacts of drops of different colors. At the same time, the computer system records the characteristics of printed dots and the position of the camera making use of position information originating from the position indexer around the displacement line. By comparing the positions of dots printed in the test pattern with their theoretical values, the differences in the positions of printed dots in each color may thus be determined and compensated in the printing system during the next production. The computer system automatically calculates these compensations and transmits them to the print process controller.

This invention also relates to a strip or sheet product (floor/wall coating, textile, poster), printed or overprinted using the synchronization system according to the invention.

This (over)printed product made using the press according to the invention comprises a fixed background image while some parts of its decoration are variable, and printed continuously by the press according to the invention. One example is the address or photo of the local distributor for an advertising poster for a large company in an international or national campaign, etc. The fixed and variable parts of the image are printed on the same substrate.

The press according to the invention can be used to print high quality color images:

- during substrate acceleration and deceleration phases;
- with a high resolution and improved precision of color superposition and juxtaposition;
- enabling simultaneous printout of several patterns in the machine;
- minimizing shutdowns, with high effective production rates;
- enabling on-line overprinting of products that include a first pre-printed basic pattern, with excellent relative positioning of the images;

enabling printing with large distances between print heads, particularly so that cross-linking and/or drying systems can be inserted between these units for printing different colors.

BRIEF DESCRIPTION OF THE DRAWINGS

FIGS. 7 to 9 illustrate different characteristics of the press according to the invention.

DETAILED DESCRIPTION OF SPECIFIC EMBODIMENTS

Figure 1A:
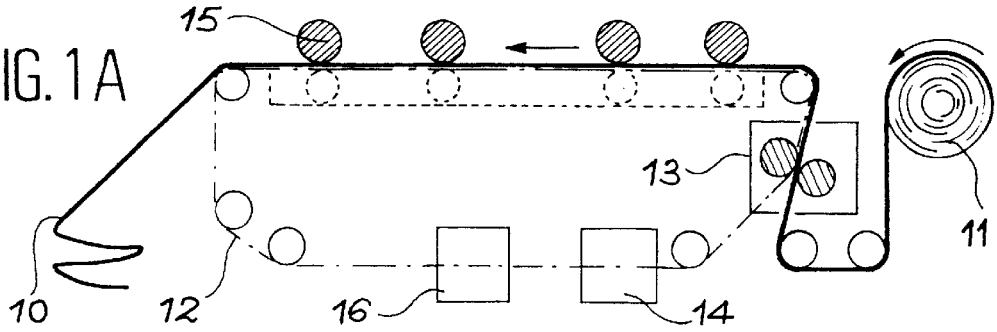
FIGS. 1A and 1B schematically show side and top views respectively of the mechanical architecture of a conventional silk screen printing press with a rotary frame.
Figure 1B:
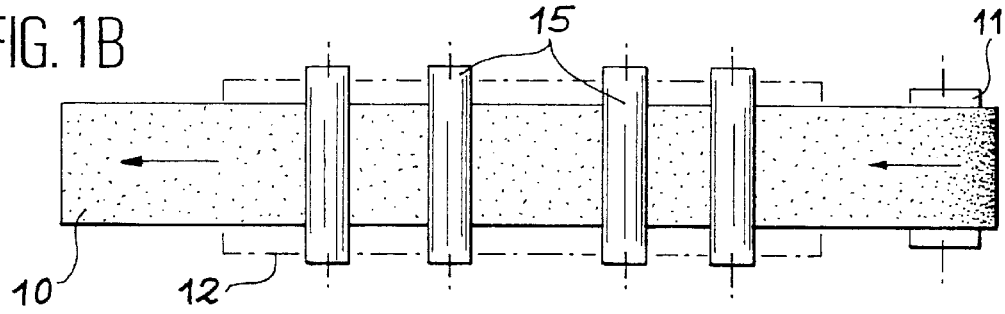

FIGS. 1A and 1B schematically represent the mechanical architecture of a conventional silk screen printing press printing on a textile substrate 10 advancing continuously, fed from a roll 11. This substrate is glued onto an adhesive conveyor belt 12. Device 13 is a substrate 10 gluing and drive device. Device 14 is a belt 12 gluing device. This conveyor belt 12, less deformable than the textile substrate 10, is moved by a motor. Therefore the textile is driven by the conveyor belt 12 and is held in position while it advances under the color print units formed of engraved silk screen printing rolls 15. Each roll 15 deposits a quantity of ink on substrate 10, the ink being circulated inside the roll and forced through orifices engraved in this roll and corresponding to the image to be printed. Each roll or rotating frame 15 applies a controlled pressure on the substrate 10 which controls the quantity of ink transferred. After printing, the substrate 10 is unglued on the output side of the conveyor belt 12 for subsequent production operations such as fixing or drying of ink. In this case, the color is printed while the previous color is still wet. The printing system includes a conveyor belt 12 cleaning device 16 to eliminate ink that passed through the fabric and impregnated it.

Figure 2A:
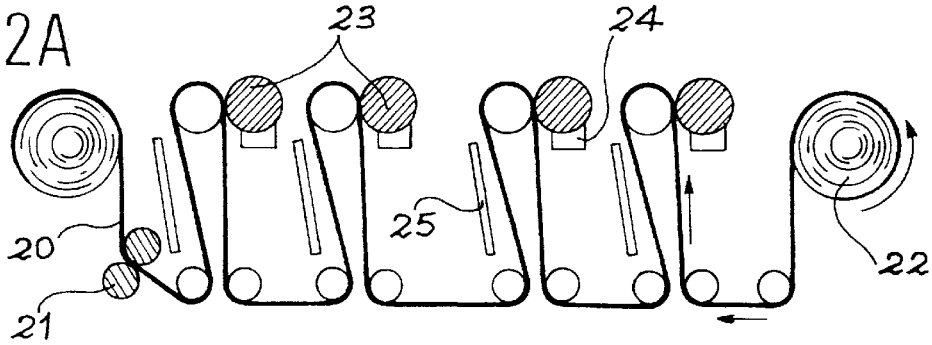
FIGS. 2A and 2B schematically show side and top views respectively of the mechanical architecture of an intaglio printing press.
Figure 2B:
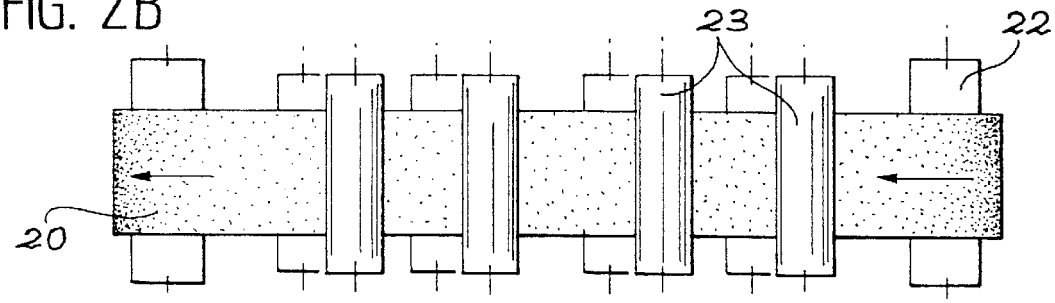

FIGS. 2A and 2B schematically represent the mechanical architecture of an intaglio printing press printing on a substrate 20 advancing continuously by means of a drive motor 21. Roll 22 is the substrate entry roll. This substrate 20, which may for example be a vinyl floor covering usually reinforced with a glass fiber fabric at the center, is mechanically stronger and less deformable than a textile. Therefore no conveyor belt is necessary and it may be mechanically stressed by the conveying system. Each print cylinder 23 includes engraved recessed cells corresponding to the image to be printed (intaglio printing process). These cells are filled with ink by an inking device 24 (inking mechanism, inking roll and scraper) in contact with the cylinder. Due to the low porosity of the substrate 20 and the conventional use of water based inks, a heating system 25 is placed between each of the print units 23, so that freshly printed ink is not transferred onto the downstream rolls by contact.

FIGS. 3A, 3B and 4A, 4B schematically represent the mechanical architectures of continuous ink jet printing machines. The ink jet print heads 30 are shown in these Figures.

Figure 3A:
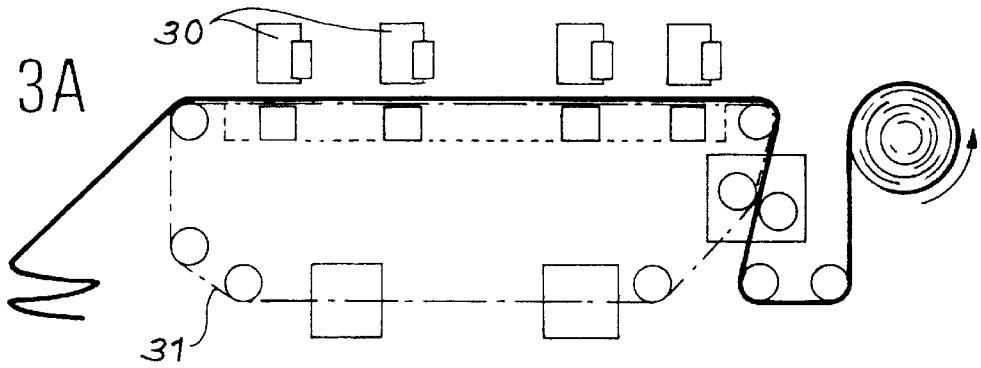
FIGS. 3A, 4A; and 3B, 4B, schematically illustrate two side views and two top views respectively of the mechanical architectures of continuous ink jet printing machines.
Figure 3B:
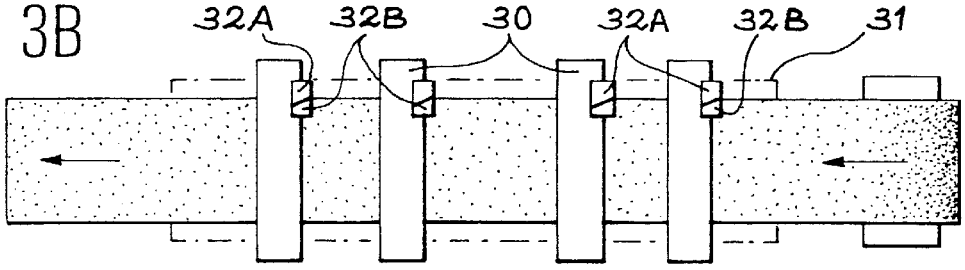

The machine in FIGS. 3A and 3B uses a conveyor belt 31 and is perfectly suitable for printing porous and deformable substrates such as textiles in rolls, and substrates consisting of sheets or plates unstacked at the input.

Figure 4A:
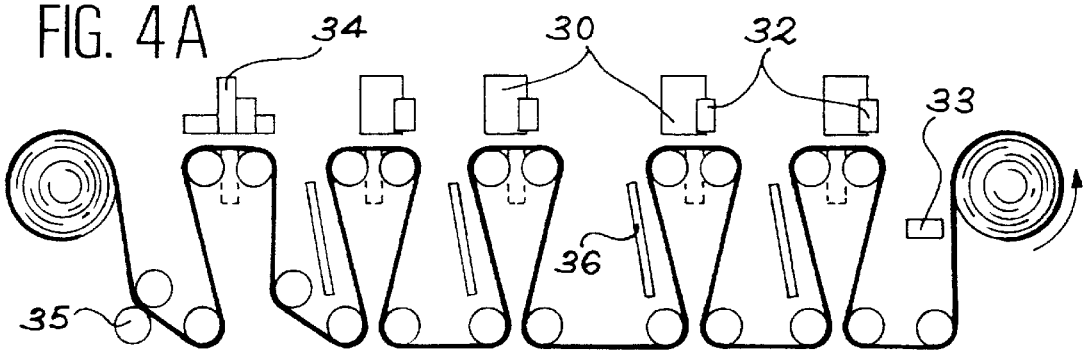
Figure 4B:
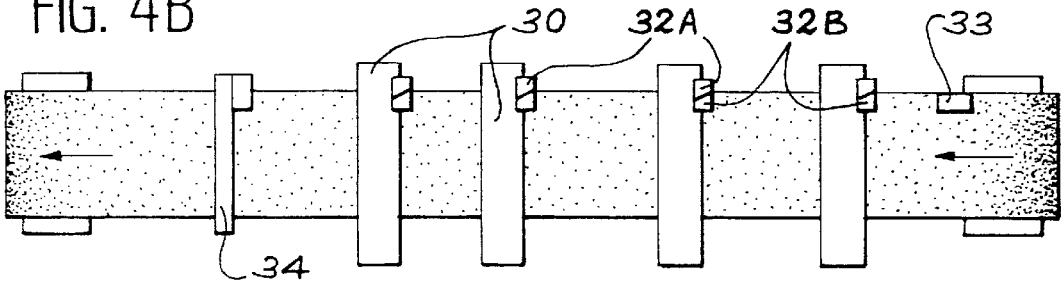

A machine such as that shown in FIGS. 4A and 4B is sometimes more suitable for mechanically strong substrates such as vinyl coatings. These FIGS. 4A and 4B show first and second mark readers 32A and 32B, a marking device 33 for first marks, a calibration test pattern reader 34, a drive motor 35, and drying devices 36.

These machine architectures are directly suitable for traditional silk screen printing or intaglio printing machines shown in FIGS. 1 and 2 respectively, which operate by contact. A fundamental difference in the manufacture is due to the fact that printing of ink jet droplets must be synchronized with the displacement of the substrate, by means of a simple and robust process that works in an industrial environment, even during transient speed phases; this is the purpose of the invention.

Figure 5:
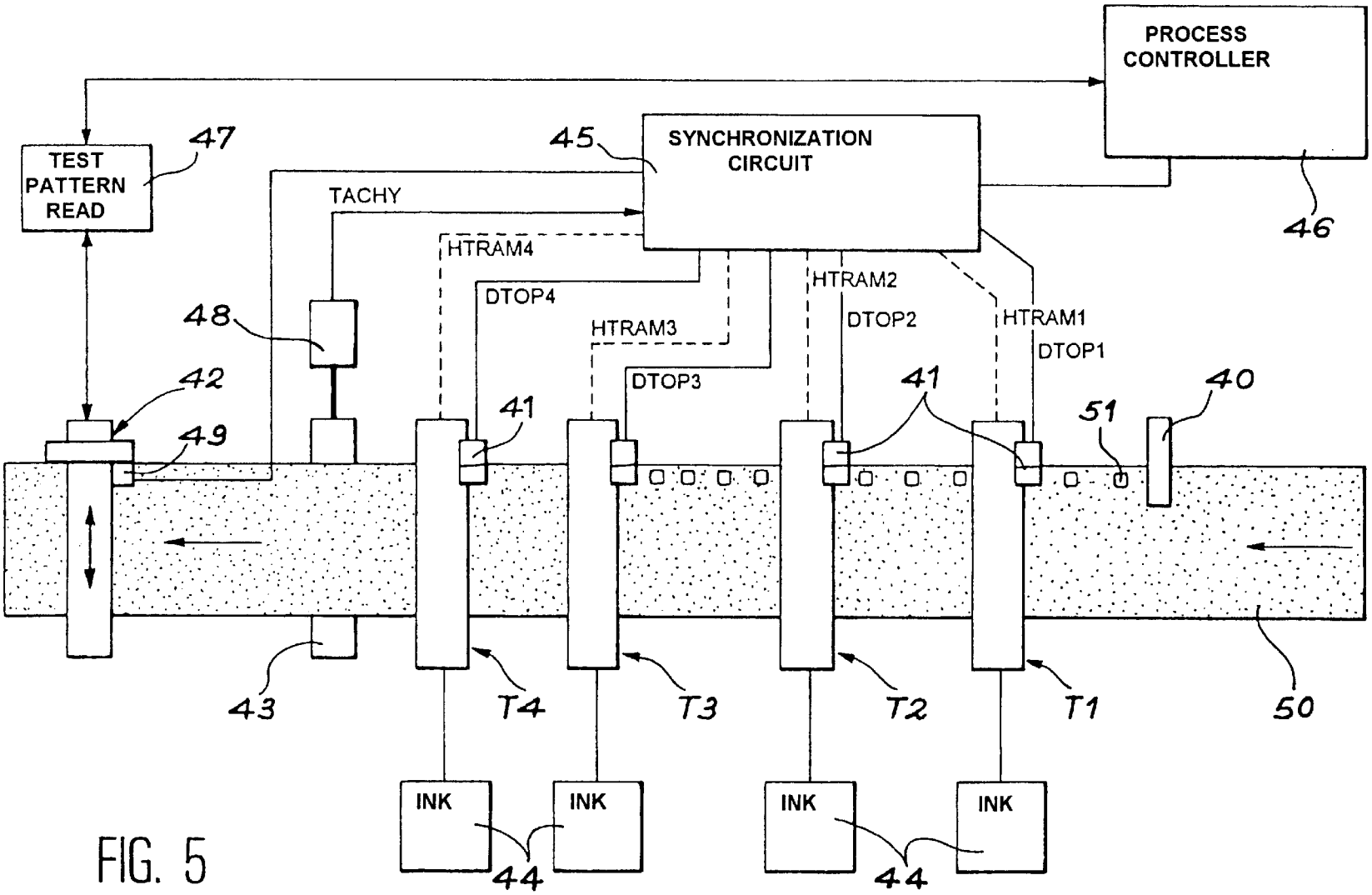
FIG. 5 illustrates a functional architecture of an ink jet press according to the invention.

FIG. 5 shows the functional architecture of an ink jet press according to the invention.

This Figure shows a printer 40 for the first marks 51, sensors 41 and 49, a color camera 42, a drive motor 43, ink circuits 44 connected to several print heads T1, T2, T3 and T4 respectively, and a synchronization circuit 45 connected to heads T1, T2, T3 and T4 and to sensors 41 (reference 32 in FIGS. 3 and 4) and 49, and a calibration test pattern read circuit 47 connected to a process controller computer system 46.

The substrate 50 is driven directly as shown in FIG. 4; or indirectly, glued or simply carried on a conveyor belt as shown in FIG. 3, to pass under the successive print heads T1, T2, T3 and T4. It may be moved by one (or several) motor drive device(s) Each print head T1, T2, T3 or T4 prints ink associated with a primary color of the image to be printed. Printing is done by simultaneously controlling a large number of jets placed in parallel as described in document reference [1]. Each print head is supplied with ink through an ink circuit 44 specific to it. The computer system 46 called the "process controller" supervises printing of each of these print heads T1, T2, T3 or T4.

Figure 6:
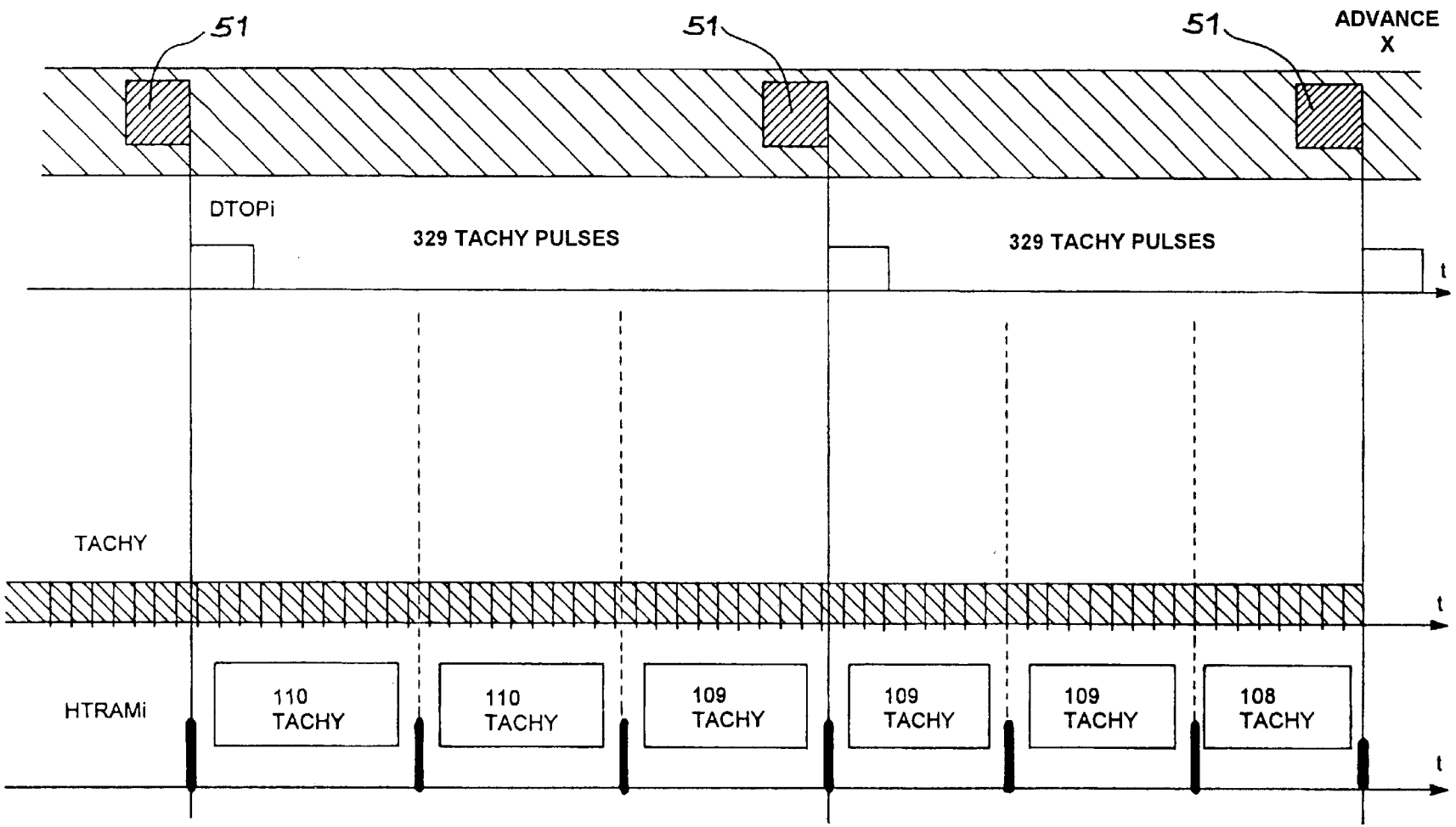
FIG. 6 illustrates synchronization of the printing system illustrated in FIG. 5.
Figure 9:
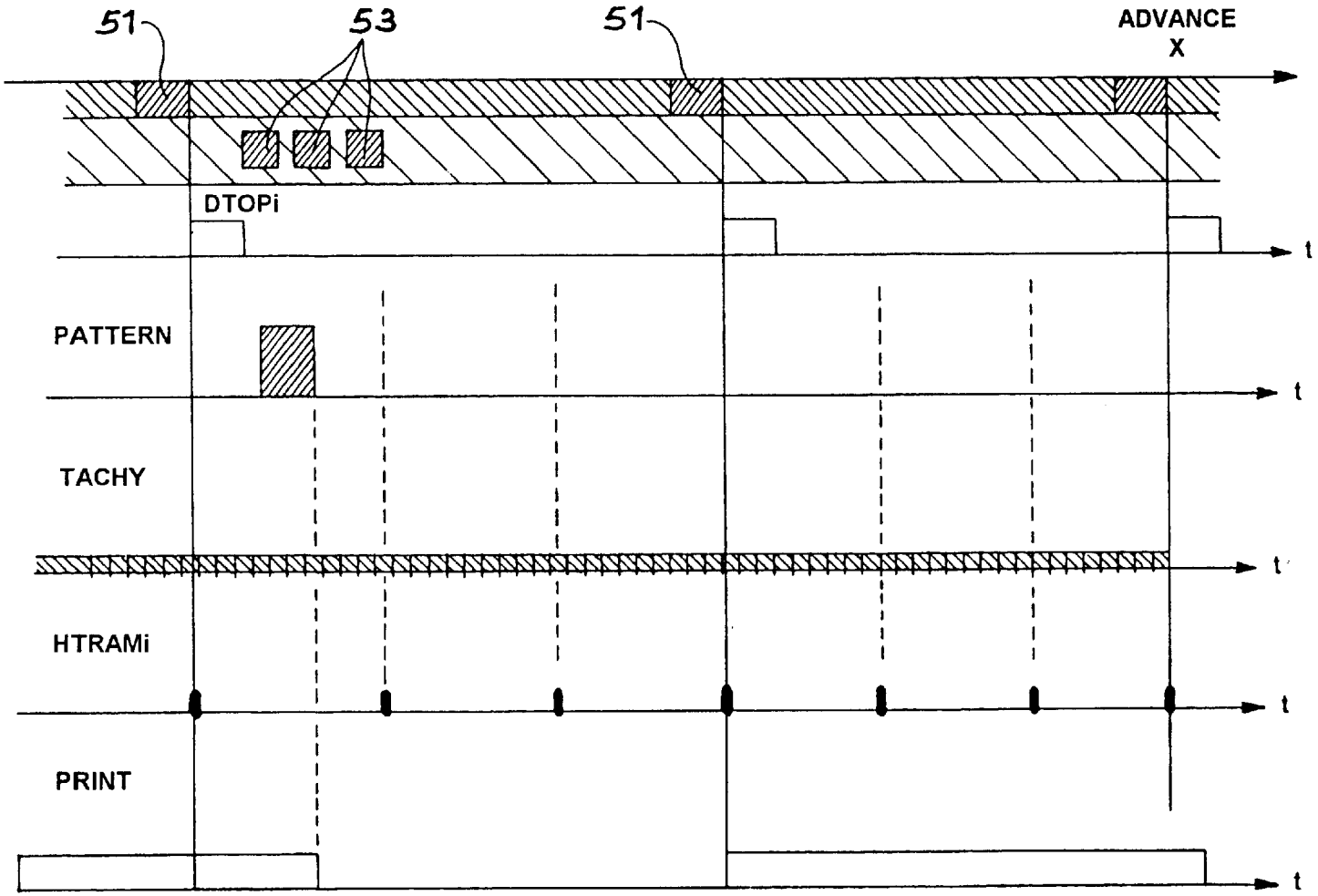

According to a first characteristic of the invention, motor 43 is equipped with a high resolution position encoder 48, typically 3,000 to 300,000 dots per motor revolution which gives a high frequency pulse (typically 100–500 kHz) representing a pitch of a few microns (3 to 30 microns) in advance of the substrate 50. This resolution is of the order of ten to fifty times lower than the addressability, i.e. the nominal distance between adjacent lines of printed dots, measured in the direction of advance of substrate 50. Due to the synchronization system, this resolution makes it possible to precisely position droplets in the different colors with a precision exceeding about 1/10 of the addressability. This resolution would be impossible using a system operating based on printed marks read on the substrate. The signal output from encoder 48, denoted TACHY, is transferred to the synchronization circuit 45. This signal, shown in FIGS. 6 and 9, gives an approximate image of the speed and position of substrate 50. It is inaccurate in the sense that it does not take account of any slipping or deformation of the substrate. The use of the rotary encoder 48 placed on the motor, and preferably operating by means of an optical device, gives a very high resolution signal.

The TACHY signal is used as a basis for generating a clock frame denoted HTRAMi, associated with each,color print head Ti. This time clock is the print start signal for each line of dots. By construction, the period of the HTRAMi signal is a multiple of the TACHY signal (therefore it contains an integer number of TACHY pulses), typically between 10 and 50 pulses depending on the addressability. This number of TACHY pulses contained in the HTRAMi signal period is variable with time, and is also different for each print head Ti as a function of the second DTOPi signal described below.

According to a second characteristic of the invention, these first marks 51 are regularly printed on the substrate 50, preferably using a printing system 40 located on the input side of print heads Ti. If a conveyor belt is being used, these first marks may be printed or simply materialized during production on the same conveyor belt. The marks must already be present (and therefore pre-printed) at the entry to the printing system if the product is being overprinted.

The geometry and color of these marks 51 is such that they can be unambiguously read in an industrial environment by an optical system such as a CCD camera and lighting, or a sensor measuring the optical reflection of the substrate. A square block with a typical size of 5 mm×5 mm (or 1 cm×1 cm) and a fluorescent color are particularly suitable choices. These marks may indifferently be printed on the front or back of the substrate, depending on the best lighting conditions and the reading system.

A first mark 51 on each print head Ti is read by the associated sensor 41 which is an optical system. This reading enables generation of a precise time signal pulse denoted DTOPi in FIG. 6. This DTOPi signal defines the instant at which a mark 51 passes under a sensor 41 associated with a print head Ti. Preferably, the DTOPi signal may be generated by appropriate processing of the optical sensor 41 read signal, using wired operators such as smoothing and time drift, in order to translate the precise instant at which an edge of the printed mark 51 passes. The distance between two marks 51 may be of the order of 100 to 5000 lines of printed dots. Thus, the reading frequency of these marks 51 is about 100 to 5000 times lower than the reading frequency of the HTRAMi signal.

In the synchronization circuit according to the invention, the duration between two successive pulses of the DTOPi signal permanently contains an integer and constant number of periods of the HTRAMi signal denoted M in the Figures. This means that the number M of lines of printed dots between two marks 51 on the substrate is always the same, for each color. Thus, since the marks 51 are physically related to the substrate, the relative positioning of the different colors remains correct even if the substrate is deformed between two print heads. In practice, the distance between marks 51 is chosen such that for extreme substrate deformation conditions (maximum acceleration, maximum deceleration), the change in the length of the substrate 50 between two consecutive marks 51 is less than the addressability (the distance between successive lines of dots). This constraint is compatible with typical substrate advance and deformation characteristics (or the characteristics of the conveyor belt if applicable) (maximum deformations of the order of 1%).

The HTRAMi clock correction principle to take account of deformation of the substrate 50 is described in detail in FIG. 8. In practice, each optical sensor 41 generating a DTOPi signal is not placed at the location of the associated print head Ti, but is before it. More precisely, it is located at a distance slightly greater than the distance separating two first marks and less than twice this distance. This offset enables the synchronization circuit 45 to count TACHY pulses in the interval between successive marks 51, before the first DTOPi interval passes under the print head, and therefore to calculate the corrected values of parameters of the HTRAMi clock and transmit them to the print head.

The number of TACHY pulses is redistributed into M approximately equal periods to form the HTRAMi clock which synchronizes the printout of dots at the print head Ti.

When the substrate advance speed is set up, its deformations are low to zero and successive pulses of the HTRAMi signal differ by not more than one TACHY pulse. When there is a measurable deformation of the substrate, the number of TACHY pulses counted between successive marks 51 varies (this number increases when the substrate is stretched and reduces when the substrate relaxes). The ΔTACHY difference between the numbers of TACHY pulses measured for two intervals between the first successive marks is used to modify the number of TACHY pulses in HTRAMi clocks, in order to compensate for the deformation of substrate 50. In a preferred embodiment, the ΔTACHY difference is redistributed approximately linearly in the interval between the first marks considered, as shown in FIG. 8. This compensation provides a monotonous variation of the HTRAM clock period, and particularly ensures that the first HTRAM period in the interval between the first marks considered, is equal to the last TRAM period in the previous interval. Obviously, it also ensures that the number of HTRAMi pulses in the interval between the first corresponding marks in this case is equal to M.

According to a third characteristic of the invention, second marks are printed on the substrate 50 (rather than on the conveyor belt) for substrates presented in strips. These second marks may be unambiguously distinguished from the first marks 51. These second marks may be printed at the edge of the substrate by the first print head T1. In the case of a pre-printed substrate, the second marks will have been made during pre-printing. A preferred embodiment consists of printing these second marks on the edge of the substrate on a line parallel to the direction of advance, but located at a good distance from the line of the first marks 51.

The function of these second marks is to signal the change in the pattern to be printed. These marks are read by an optical system (which may be the same or of the same type as the previous system), in order to generate a signal called PATTERN, with a coarser precision, indicating the change in the pattern to be printed. In a preferred embodiment, the PATTERN signal is identified by means of printing and detecting a fast succession of blocks 53 separated by a distance much less than the distance between the first marks as shown in FIG. 9. This redundancy of blocks means that the pattern change can be detected unambiguously. When the PATTERN signal is detected, the synchronization circuit 45 gives orders to the print head to stop printing the current production and go on to the next production as soon as the next DTOPi signal pulse is received.

For substrates in sheet form (pre-printed or not), the mark 53 is naturally generated by the appearance of the trailing edge of the sheet under the optical sensor, and synchronization is done in a manner similar to the case of the strip substrate.

According to another characteristic of the invention, the synchronization circuit 45 carries out prediction, filtering and windowing operations on the DTOPi signal read operation in order to make the system highly robust. Detection of a first mark 51 is firstly authorized in a limited time window which is centered on the instant at which this mark will probably pass under the sensor. This solution limits disturbing detections which may be related to the presence of parasites (printed defects or electrical disturbances). If a first mark 51 is not detected in the read window, a dummy DTOPi signal is generated starting from a prediction based on the interval between the first previous marks. This means that printing can be continued, particularly when a pattern is changed or between two pre-printed or non pre-printed sheets, even when the first mark 51 could not be detected. At the same time, the read window is widened for the next detection instant. Printing is stopped if the defect persists after four missing DTOPi pulses.

In order to obtain satisfactory synchronization, it is often necessary to take account of exact time differences between each sensor and each associated print head, and between different print heads. These differences are expressed as integer and fractional numbers of HTRAMi. Similarly, there may be some offsets between ink jets in the same print unit. In a preferred embodiment, these offsets in the print system are measured by intermittently analyzing multicolor calibration test patterns printed by the print system over the entire width of the substrate. The calibration test patterns comprise geometric patterns that can unambiguously identify dots printed by the different print units. These test patterns are printed during the sequenced printed product production process. The test patterns may be analyzed at the exit from the machine if the product residence time in the line is short, so that corrections and calibration can be done within a short period. However, if the production line is long, which is the case for a vinyl floor covering which has to remain for several minutes in ovens placed in line immediately below the printing location, then the test patterns must be analyzed on line before the substrate exits from the production line.

According to another characteristic of the invention, a system is installed after the print heads for analyzing test patterns consisting of a color camera (CCD type) equipped with suitable optics, and mounted on a mechanical displacement system with a macrometric position indexer placed approximately perpendicular to the substrate advance direction, and an associated processing system. The substrate 50 conveyor line is stopped intermittently when the calibration test pattern is approximately within the zone being scanned by the camera. The presence of the calibration pattern on the substrate can be detected by printing a characteristic PATTERN mark on the edge of the substrate, indicating the presence of a calibration test pattern. The PATTERN mark is detected by an optical sensor 49 associated with the test pattern analysis system, similar to readers of second marks 41 associated with print heads Ti; it momentarily stops the substrate. When the substrate stops under the analysis system, the camera 42 is moved by the mechanical system (transverse to the substrate advance direction) at the same time that it analyzes the impacts of different colors of droplets. The processing system simultaneously records the characteristics of printed dots and the position of the camera 42 by making use of position information originating from the position indexer on the displacement axis. By comparing the positions of dots with their theoretical values, the variations of positions can thus be determined and compensated in the printed system during the next production. These compensations are automatically calculated by the processing system and are transmitted to the print process controller.

Even if momentarily stopping the substrate to read the calibration test pattern penalizes the global productivity of the printer, this solution appears the most robust way of unambiguously and precisely measuring dots printed in different colors on an industrial substrate, the texture of which may sometimes be complex. Since printing is possible during acceleration and deceleration phases, this calibration phase only causes minor losses of the substrate, limited to the area of the test patterns which may themselves be very compact, limited to one, two or three DTOP intervals.

REFERENCES

[1] FR-A-91 11151

[2] "Design of a Paper Drive Mechanism of a Single-Pass Color Electrostatic Plotter for Accurate Image Registration" by M. Dizechi, published in the "Journal of Imaging Technology", volume 15, number 16, December 1989

[3] U.S. Pat. No. 5,452,073

[4] "A Strategy for Tandem Color Registration" by Caselli et al. in SPIE, volume 2658, pages 96–104, 1995.

We claim:

1. Continuous multicolor ink jet press comprising:

multiple print heads each supplied with a specific color ink through a respective ink circuit;

a substrate passing successively under the print heads;

a motor driving the substrate;

a high resolution rotary encoder disposed on the motor and providing a high frequency pulse;

a printing system upstream of the print heads for regularly printing first marks on the substrate;

multiple sensors for reading the first marks, each sensor being associated with one of the print heads;

a synchronization circuit connected to the print heads, the sensors, and the encoder; and a process controller controlling the synchronization circuit for supervising printing of each of the print heads.

2. Press according to claim 1, in which the encoder comprises 3,000 to 300,000 dots per motor revolution.

3. Press according to claim 1, in which the encoder operates by means of an optical device.

4. Press according to claim 1, comprising a conveyor belt, the first marks being materialized during manufacture on this conveyor belt.

5. Press according to claim 1, in which each sensor is an optical system for reading these first marks, which outputs a pulse signal defining the instant at which a first mark passes under this sensor.

6. Press according to claim 5, comprising a circuit for processing the read signal from the optical sensor outputting this pulse signal; this circuit uses hard wired operators such as smoothing and time drift in order to translate the precise instant at which one side of the printed mark passes.

7. Press according to claim 5, in which a first mark is formed of a square block with a side a few millimeters long.

8. Press according to claim 1, in which a first mark has a fluorescent color.

9. Press according to claim 1, in which the distance between the first two marks is of the order of the distance separating 100 to 5000 lines of printed dots.

10. Press according to claim 5, in which there is always the same number M of dots printed on the substrate between two first marks for each color.

11. Press according to claim 5, in which each optical sensor is placed on the input side of the associated print head, the separation between the print heads being slightly greater than the distance between two marks, and less than twice this distance.

12. Press according to claim 1, in which the first print head prints second marks.

13. Press according to claim 12, in which these second marks are printed on the edge of the substrate.

14. Press according to claim 13, in which these second marks are located on the edge of the substrate on a line parallel to the advance direction, at the right distance from the line of the first marks.

15. Press according to claim 12, comprising an optical system for reading these second marks, that generates a signal indicating the change in the pattern to be printed.

16. Press according to claim 12, in which a second mark is formed of a succession of blocks separated by a distance far less than the distance between two first marks.

17. Press according to claim 16, for substrates in sheets, in which a second such mark is generated by the appearance of the trailing edge of the sheet under the read system.

18. Press according to claim 1, in which the synchronization circuit carries out prediction, filtering and windowing operations of the signal read operation corresponding to passage of a first mark under a sensor.

19. Press according to claim 1, including a system for analyzing test patterns on the output side of the print heads, including a color camera equipped with adapted optics, mounted on a mechanical displacement system with a macrometric position indexer placed approximately perpendicular to the direction of advance of the substrate, and a processing system.

20. Press according to claim 19, in which the calibration test patterns include geometric patterns that unambiguously identify dots printed by the various print units covering the width of the substrate.

21. Press according to claim 19, in which the presence of a calibration test pattern on the substrate is detected by means of printing a characteristic mark at the edge of this substrate.

22. Press according to claim 21, in which the detector of the presence of a test pattern mark is similar to the sensors associated with the print heads.

23. Press synchronization process for a press including a substrate driven by a motor: comprising the steps of moving the substrate under at least one print head associated with a sensor; supplying ink to the print head through an ink circuit; transmitting a signal from an encoder on the substrate drive motor to a synchronization circuit connected to a process controller; and printing marks regularly on the substrate, in which the detection of a first mark is authorized firstly within a limited time window centered on the instant at which a first mark will probably pass under a sensor.

24. Process according to claim 22, in which if the first mark is not detected within the read window, a dummy signal is generated starting from a first prediction based on the previous interval, and that the read window is simultaneously widened for the next detection instant, the printout being stopped if the defect persists after four missing signals.

25. Process according to claim 23, in which the offsets in the print system are measured by intermittently analyzing multi-color calibration marks printed by the print system, these calibration patterns comprising geometric patterns which unambiguously identify dots printed by the various print units.

26. Process according to claim 25, in which the test patterns are analyzed at the exit from the line, if the product residence time in the line is short.

27. Process according to claim 25, in which the test patterns are analyzed in line by momentarily stopping the advance of the substrate when the production line is long.

28. Process according to claim 23, in which when the substrate is stopped under the analysis system, a camera is moved by the mechanical system transversely to the direction of advance of the substrate at the same time as it analyzes impacts of droplets of different colors, and in which a processing system simultaneously records the characteristics of printing dots and the camera position making use of position information output from the position indexer on the displacement axis, and in which by comparing the positions of dots with their theoretical values, the position differences can thus be determined and compensated in the print system during the next production, and in that these compensations are automatically calculated by a processing system and are transmitted to a print process controller.

29. Printed product obtained by means of the press according to claim 1, comprising a fixed background image and some variable parts of the decoration, printed continuously by the said press.

* * * * *

UNITED STATES PATENT AND TRADEMARK OFFICE

CERTIFICATE OF CORRECTION

PATENT NO. : 6,068,362

DATED : May 30, 2000

INVENTOR(S) : Dunand et al.

It is certified that error appears in the above-identified patent and that said Letters Patent is hereby corrected as shown below:

On Title Page, Section [57], ABSTRACT, line 2, after "substrate", insert --(50)--.

On Title Page, Section [57], ABSTRACT, line 2, after "motor", insert --(43)--.

On Title Page, Section [57], ABSTRACT, line 3, after "head", insert --(Ti)--.

On Title Page, Section [57], ABSTRACT, line 3, after "sensor", insert --(41)--.

On Title Page, Section [57], ABSTARCT, line 4, after "circuit" (first occurrence), insert --(44)--.

On Title Page, Section [57], ABSTRACT, line 4, after "circuit" (second occurrence), insert --(45)--.

UNITED STATES PATENT AND TRADEMARK OFFICE

CERTIFICATE OF CORRECTION

PATENT NO. : 6,068,362

DATED : May 30, 2000

INVENTOR(S) : Dunand et al.

It is certified that error appears in the above-identified patent and that said Letters Patent is hereby corrected as shown below:

On Title Page, Section [57], ABSTRACT, line 5, after "controller", insert --(46)--.

On Title Page, Section [57], ABSTRACT, line 5, after "encoder", insert --(48)--.

On Title Page, Section [57], ABSTRACT, line 6, after "signal", insert --(TACHY)--.

On Title Page, Section [57], ABSTRACT, line 7, after "circuit", insert --(45)--.

Column 8, line 66, delete "each,color" and insert --each color--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*